US007950651B2

(12) United States Patent
Wylie

(10) Patent No.: US 7,950,651 B2
(45) Date of Patent: May 31, 2011

(54) MEDIA STACKER

(75) Inventor: Christopher W. Wylie, Dundee (GB)

(73) Assignee: NCR Corporation, Duluth, GA (US)

( * ) Notice: Subject to any disclaimer, the term of this patent is extended or adjusted under 35 U.S.C. 154(b) by 48 days.

(21) Appl. No.: 12/542,389

(22) Filed: Aug. 17, 2009

(65) Prior Publication Data

US 2011/0037219 A1 Feb. 17, 2011

(51) Int. Cl.
*B65H 29/20* (2006.01)

(52) U.S. Cl. ..... 271/187; 271/315

(58) Field of Classification Search ..... 271/187, 271/315

See application file for complete search history.

(56) References Cited

U.S. PATENT DOCUMENTS 1,956,541 A * 4/1934 Spillane ..... 198/374
4,522,387 A * 6/1985 Leuthold ..... 271/187
4,647,032 A * 3/1987 Oba ..... 271/186
4,886,260 A * 12/1989 Reist ..... 270/60
6,341,776 B1 * 1/2002 Whitten ..... 271/187
6,554,273 B1 4/2003 Holland-Letz et al.
2002/0113366 A1 * 8/2002 Watanabe et al. ..... 271/315
2007/0257427 A1 * 11/2007 Crerar ..... 271/315
2008/0136096 A1 * 6/2008 Crerar ..... 271/306

* cited by examiner

*Primary Examiner* — David H Bollinger
(74) *Attorney, Agent, or Firm* — Paul W. Martin

(57) ABSTRACT

A media stacker unit comprises: (i) at least one stacker wheel and (ii) a detent. The stacker wheel includes: a hub for mounting on an axle, and a plurality of arcuate tines, each tine being coupled to the hub at a hub end and extending transverse to the axle to a point radially spaced from the axle at a capture end. When the stacker wheel is rotated about the axle, the capture ends traverse a capture circumference. Each tine further comprises a resilient tine portion. The detent partially extends within the capture circumference for engaging with and temporarily retarding a capture end as the stacker wheel is rotated. This reduces the time during which that capture end blocks a media transport path, thereby reducing the possibility of a media item colliding with a capture end and jamming the media stacker unit.

12 Claims, 2 Drawing Sheets

MEDIA STACKER

FIELD OF INVENTION

The present invention relates to an improved media stacker.

BACKGROUND INVENTION

Media stackers typically include wheels that are used to collate media items, such as banknotes, to enable those collated media items to be conveyed as a bunch.

A stacker wheel typically comprises an axially-mounted hub, and a plurality of arcuate tines extending transverse to the axle on which the hub is mounted.

A stacker unit comprises a plurality of mutually coupled but axially separated stacker wheels. The stacker wheels are rotated in unison as media items are fed into the stacker wheels from one side (the media item input side). The speed at which the media items are conveyed is synchronized with the rotation of the stacker wheels so that only one media item is stored between adjacent tines.

A pivoting collecting plate is typically located at the opposite side of the stacker unit to the media item input side. The collecting plate comprises a plurality of arms, each arm extending between adjacent stacker wheels. As the stacker wheels rotate, media items stored in the stacker unit engage with the arms, which remove the media items from the stacker unit and arrange them as a bunch of media items. The collecting plate is then pivoted away from the stacker unit and the bunch of media items can be transported.

One problem associated with a stacker unit is that it is possible for a media item to collide with the end of a tine of a stacker wheel, so that the media item crumples and jams the stacker unit instead of entering the stacker unit.

U.S. Pat. No. 6,554,273 attempts to solve this problem by monitoring the trailing edge of a note as it enters the stacker wheel and adjusting the rotational speed of the stacker wheels accordingly. This requires accurate measurement of the media item being transported and accurate control of the stacker wheel speed.

It is among the objects of an embodiment of the present invention to mitigate the above problem or another problem associated with prior art stacker wheels or stacker units.

SUMMARY OF INVENTION

Accordingly, the invention generally provides methods, systems, and apparatus for a media stacker.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media stacker unit comprising: (i) at least one stacker wheel including: a hub for mounting on an axle, and a plurality of arcuate tines, each tine being coupled to the hub at a hub end and extending transverse to the axle to a point radially distal from the axle at a capture end so that when the stacker wheel is rotated about the axle the capture ends define a capture circumference, each tine further comprising a resilient tine portion; and (ii) a detent partially extending within the capture circumference for engaging with and temporarily retarding successive capture ends as the stacker wheel is rotated to reduce the time during which each capture end blocks a media transport path.

The stacker unit may comprise two or more stacker wheels.

The hub and arcuate tines may be manufactured from the same type of material.

The resilient tine portion may extend the entire length of the tine or may extend for only part of the length of the tine.

Suitable materials for the capture end of the arcuate tines include polyoxymethylene and polyamide, due to their hard-wearing, low friction properties. The entire stacker wheel may be composed of the same material, for example, polyoxymethylene or polyamide. The entire stacker wheel may be stamped from a polyamide sheet.

The arcuate tines may include a flex point. The flex point may define an area of reduced cross section so that the capture end pivots about the flex point when the associated capture end is retarded by the detent.

The detent may comprise a metal, alloy, or plastics material. Other convenient materials may be used.

The detent may include a low-friction coating on a face of the detent engaging with the capture ends of the tines.

By virtue of this aspect, successive capture ends of the arcuate tines are held back temporarily and then released so that each released capture end accelerates through a media item input zone, thereby reducing the time during which a capture end blocks the input zone. This reduces the possibility of a media item colliding with a released capture end. In effect, this enlarges the gap between adjacent tines at the input zone by reducing the gap between adjacent tines immediately before the input zone.

According to a second aspect there is provided a media dispenser including the media stacker unit of the first aspect.

According to a third aspect there is provided a self-service terminal including the media stacker unit of the first aspect.

The self-service terminal may be an automated teller machine (ATM), an information kiosk, a financial services center, a bill payment kiosk, a lottery kiosk, a postal services machine, a check-in and/or check-out terminal such as those used in the retail, hotel, car rental, gaming, healthcare, and airline industries, or the like.

According to a fourth aspect there is provided a media stacker wheel comprising: a hub for mounting on an axle, a plurality of arcuate tines, each tine being coupled to the hub at a hub end and extending transverse to the axle to a point radially separated from the axle at a capture end so that when the stacker wheel is rotated about the axle the capture ends define a capture circumference, each tine further comprising a resilient tine portion.

The resilient tine portion may be defined by an area of the tine having a reduced cross section.

Alternatively, or additionally, the resilient tine portion may be coupled to a remaining tine portion or the hub by a resilient bias, such as a leaf spring, a coil spring, or the like.

These and other aspects will be apparent from the following specific description, given by way of example, with reference to the accompanying drawings.

DETAILED DESCRIPTION

Figures 1, 2:
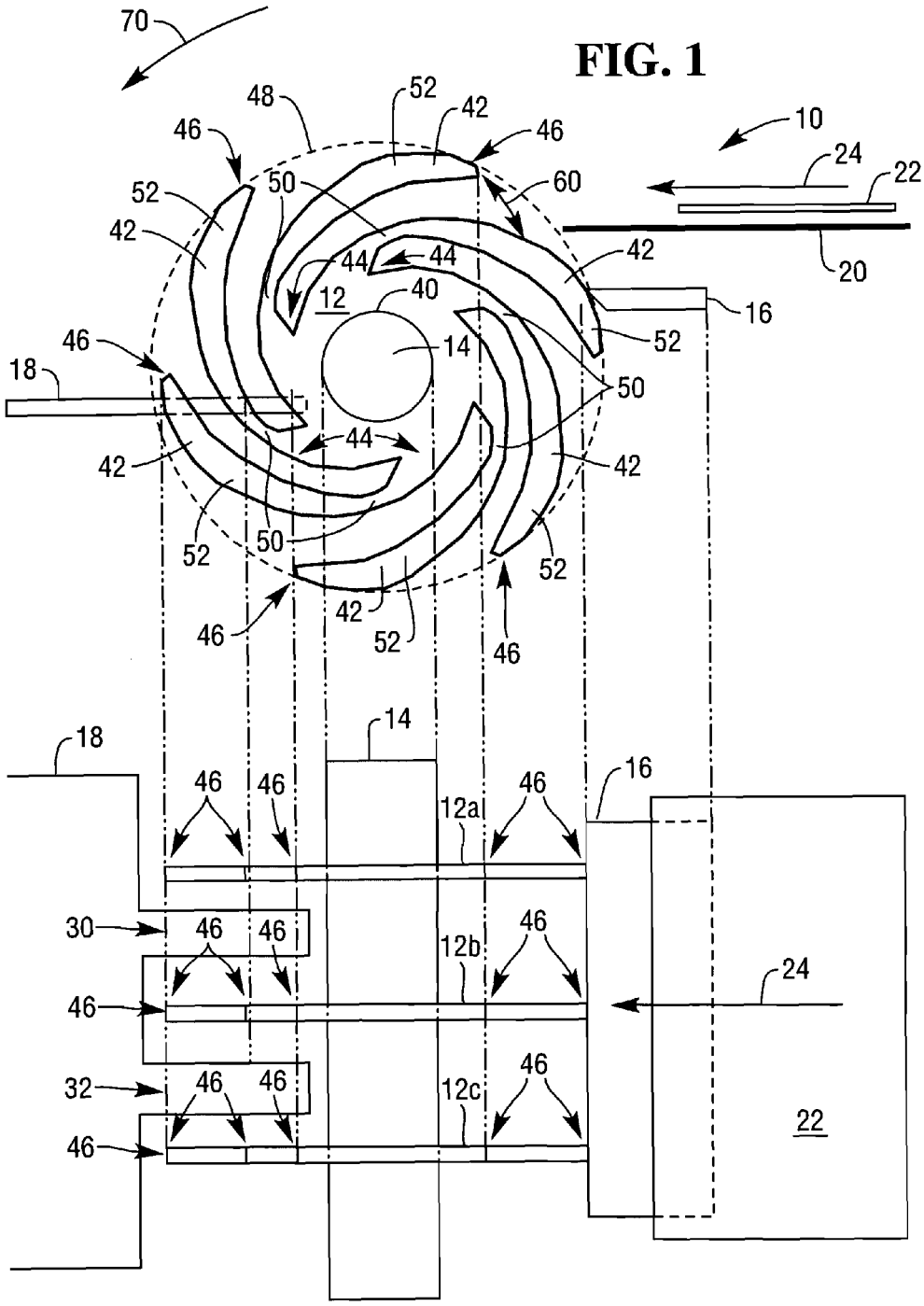
FIG. 1 is a simplified side view of a stacker unit according to one embodiment of the present invention.
FIG. 2 is a plan view of the stacker unit of FIG. 1.

Reference is first made to FIGS. 1 and 2, which are side and plan views respectively of a stacker unit 10 according to one embodiment of the present invention.

The stacker unit 10 comprises a stacker wheel 12 mounted on an axle 14 and having a detent 16 on a media item input side of the stacker unit 10. A conventional collecting plate 18 is mounted adjacent the stacker unit 10 on a collation side of the stacker unit 10.

The media item input side includes a media transport 20 for transporting media items 22 (in this embodiment, banknotes) to the stacker unit 10 in the direction shown by arrow 24.

The collecting plate 18 includes a pair of arms 30,32 extending between adjacent stacker wheels 12*a,b*, and 12*b,c* and operates in a conventional manner.

The stacker wheel 12 is made of polyamide and comprises a central hub 40 mounted on the axle 14, and a plurality of arcuate tines 42 (in this embodiment, six tines are shown). Each tine 42 is coupled to the hub 40 at a hub end 44 and extends transverse to the axle 14 to a point radially distal from the axle 14 at a capture end 46. When the stacker wheel 12 is rotated about the axle 14 the capture ends 46 traverse a capture circumference (illustrated by dotted line 48).

Each tine 42 further comprises a flex point 50 of reduced cross section defining a resilient tine portion 52 extending from the flex point 50 to the capture end 46.

Each banknote 22 is transported into an opening (illustrated by double headed arrow 60) between adjacent tines 42 immediately above the detent 16, as the stacker wheels 12 are rotated anti-clockwise (in the direction shown by arrow 70). The opening 60 comprises the media item input zone (which is part of the media transport path) through which media items enter the stacker wheels 12.

Figure 3:
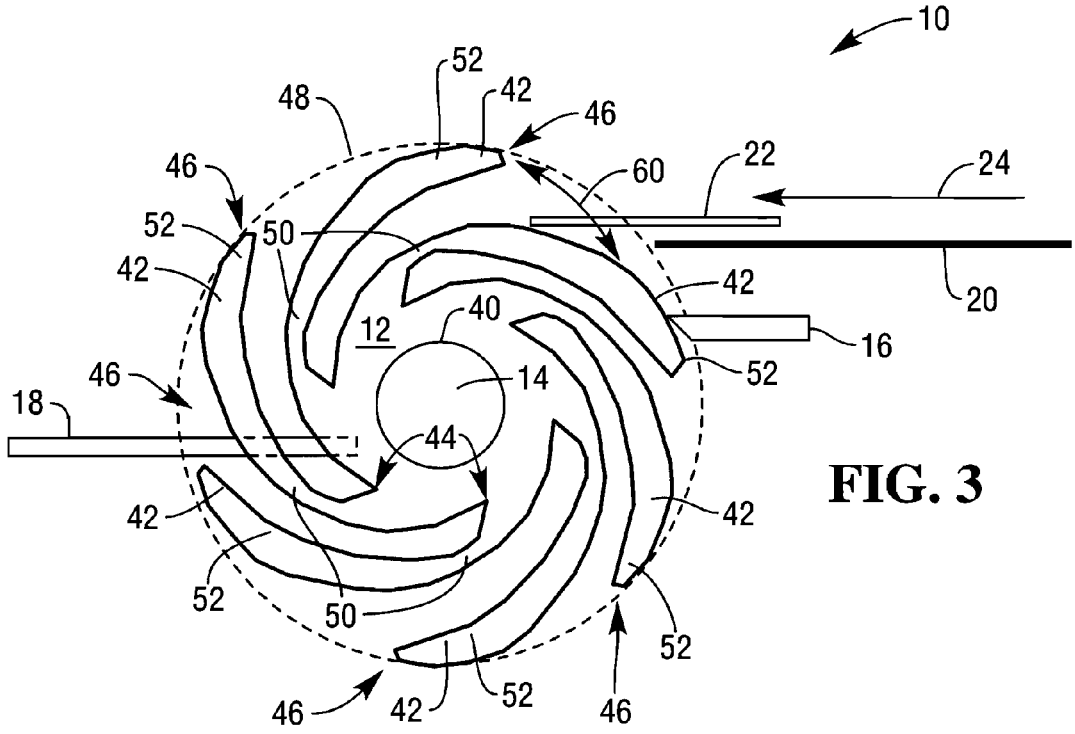
FIG. 3 is a side view of a part (a stacker wheel) of the stacker unit of FIG. 1, showing the stacker wheel in a different rotational position to the corresponding part in FIG. 1.

As shown in FIG. 3, the detent 16 partially extends within the capture circumference 48 and engages with each capture end 46, as the arcuate tines 42 rotate. As the stacker wheels 12 continue to rotate, an engaged arcuate tine 42 slides along the detent 16, which deflects the resilient tine portion 52 downwards. The detent 16 temporarily retards the engaged capture end 46 as the stacker wheel 12 rotates. This occurs because the resilient tine portion 52 of the engaged arcuate tine 42 deflects about the flex point 50. This ensures that the opening (the media item input zone) 60 between the arcuate tine 42 above the detent 16 and the arcuate tine 42 engaged by the detent 16 is temporarily widened, as illustrated in FIG. 3.

Figure 4:
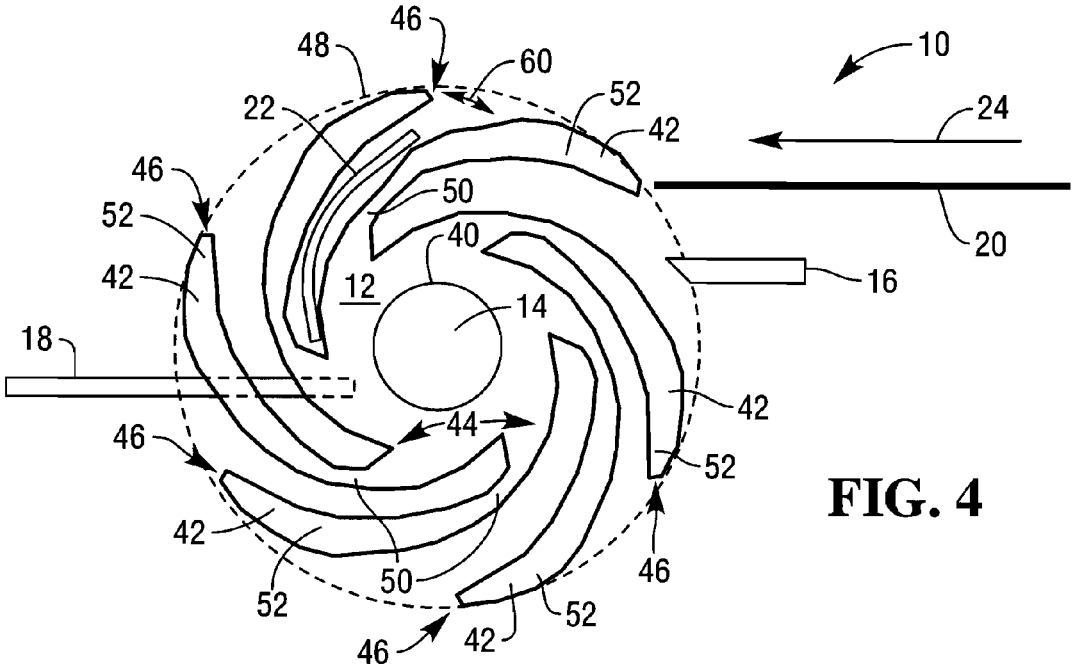
FIG. 4 is a side view the stacker wheel of FIG. 1 in yet another rotational position.

Once the stacker wheels 12 have rotated sufficiently, as illustrated in FIG. 4, the engaged arcuate tine 42 clears the detent 16, and the now disengaged arcuate tine 42 springs forward (due to the energy stored in the flex point 50) in the direction of rotation. This causes the released resilient tine portion 52 to accelerate through the banknote transport path, thereby reducing the possibility of a transported banknote 22 colliding with the capture end 46 of the now disengaged arcuate tine 42. This results in the opening 60 narrowing temporarily, as shown in FIG. 4, until the deflected resilient tine portion 52 returns to its quiescent (inactive) position, as shown in FIG. 1.

The transported banknote 22 is removed from the stacker unit 10 by the collecting plate 18 in a conventional manner.

It will now be appreciated that this embodiment has the advantage that an arcuate tine 42 is accelerated through a banknote transport path at a faster speed that on any other part of the capture circumference 48, thereby decreasing the likelihood of a banknote colliding with the capture end 46 of an arcuate tine 42. This embodiment does not require any measurement of the position of a media item being conveyed on the transport path, nor does it require the rotational speed of the stacker wheels to be varied or stopped.

Various modifications may be made to the above described embodiment within the scope of the invention, for example, in other embodiments, the flex point 50 may comprise a spring.

In other embodiments, the flex point 50 may be located at a different location to that shown, for example, at the hub end 44.

In other embodiments, a greater or smaller number of tines than six may be used in the stacker wheels.

In other embodiments, a greater or smaller number of stacker wheels than three may be used in the stacker unit.

In other embodiments media items other than banknotes, for example, checks, stamps, tickets, or the like, may be transported.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

What is claimed is:

1. A media stacker unit comprising:

(i) at least one stacker wheel including:

a hub for mounting on an axle, and a plurality of arcuate tines, each tine being coupled to the hub at a hub end and extending transverse to the axle to a point radially distal from the axle at a capture end so that when the stacker wheel is rotated about the axle the capture ends define a capture circumference, each tine further comprising a flex point having a reduced cross section and a resilient tine portion extending therefrom; and (ii) a detent partially extending within the capture circumference for engaging with and temporarily retarding successive capture ends as the stacker wheel is rotated to reduce the time during which each capture end blocks a media transport path.

2. A media stacker unit according to claim 1, wherein the stacker unit comprises a plurality of stacker wheels.

3. A media stacker unit according to claim 1, wherein the hub and arcuate tines comprise the same type of material.

4. A media stacker unit according to claim 1, wherein the resilient tine portion extends substantially the entire length of the tine.

5. A media stacker unit according to claim 1, wherein the resilient tine portion extends for only part of the length of the tine.

6. A media stacker unit according to claim 1, wherein the arcuate tines comprise polyoxymethylene or polyamide.

7. A media stacker unit according to claim 1, wherein the detent comprises a metallic material.

8. A media stacker unit according to claim 1, wherein the detent comprises an alloy.

9. A media stacker unit according to claim 1, wherein the detent comprises a plastics material.

10. A media stacker unit according to claim 1, wherein the detent includes a low-friction coating on a face of the detent engaging with the capture ends of the tines.

11. A media dispenser including the media stacker unit of claim 1.

12. A self-service terminal including the media stacker unit of claim 1.

* * * * *